United States Patent [19]

Andree et al.

[11] 4,171,278

[45] Oct. 16, 1979

[54] SURFACE-ACTIVE COMPOUND COMBINATION CONTAINING HYDROXYALKYLAMINES

[75] Inventors: Hans Andree; Günter Jakobi, both of Hilden; Wolfgang Rupilius, Düsseldorf; Horst Rutzen, Langenfeld; Ulrich Zeidler, Düsseldorf; Markus Berg, Düsseldorf; Jochen Kaufmann, Düsseldorf; Gunther Vogt, Tönisvorst, all of Fed. Rep. of Germany

[73] Assignee: Henkel Kommanditgesellschaft auf Aktien, Düsseldorf-Holthausen, Fed. Rep. of Germany

[21] Appl. No.: 941,902

[22] Filed: Nov. 2, 1978

Related U.S. Application Data

[63] Continuation-in-part of Ser. No. 784,739, Apr. 5, 1977, abandoned, which is a continuation-in-part of Ser. No. 766,626, Feb. 7, 1977, abandoned.

[30] Foreign Application Priority Data

| | | | |
|---|---|---|---|
| Feb. 6, 1976 | [AT] | Austria | 84076/76 |
| May 3, 1976 | [AT] | Austria | 3234/76 |
| Nov. 2, 1976 | [AT] | Austria | 8088/76 |
| Nov. 11, 1976 | [AT] | Austria | 8373/76 |

[51] Int. Cl.[2] ..... C11D 1/44

[52] U.S. Cl. ..... 252/102; 252/529; 252/548; 260/584 B

[58] Field of Search ..... 252/548, 544, 529, 525, 252/102, 8.8 R; 260/584 B

[56] References Cited

U.S. PATENT DOCUMENTS

| | | | |
|---|---|---|---|
| 3,207,791 | 9/1965 | Meyers et al. | 252/548 X |
| 3,741,912 | 6/1973 | Kaneko | 252/548 X |
| 3,850,853 | 11/1974 | Marumo | 252/548 |
| 3,855,156 | 12/1974 | Marumo | 252/548 X |
| 3,897,347 | 7/1975 | Eckert et al. | 252/548 X |
| 3,931,033 | 1/1976 | Lohr et al. | 252/DIG. 1 X |
| 3,985,670 | 10/1976 | Berg et al. | 252/DIG. 1 X |
| 4,049,557 | 9/1977 | Wixon | 260/584 B X |

*Primary Examiner*—Harris A. Pitlick
*Attorney, Agent, or Firm*—Hammond & Littell

[57] ABSTRACT

A surface-active compound combination for use in textile washing agent compositions consisting essentially of (1) at least one tenside of the anionic sulfonate or sulfate type or non-ionic ethoxylated type, and (2) at least one hydroxyalkylamine having vicinal oxygen and nitrogen bridging atoms, ethoxylated/propoxylated derivatives thereof, acylated derivatives thereof, or ethoxylated/propoxylated acylated derivatives thereof, where the amount of component (1) to component (2) is in the weight ratio of 100:1 to 1:1. The surface-active compound composition is useful in preparation of low temperature detergents and low phosphate detergents.

29 Claims, No Drawings

SURFACE-ACTIVE COMPOUND COMBINATION CONTAINING HYDROXYALKYLAMINES

REFERENCE TO PRIOR APPLICATION

This application is a continuation-in-part of Ser. No. 784,739, filed Apr. 5, 1977 and now abandoned, now which in turn is a continuation-in-part of Ser. No. 766,626, filed Feb. 7, 1977, and now abandoned.

STATE OF THE ART

New textile materials and consumer habits present the detergents expert with the problem of constantly checking and rechecking the formulas of the detergents being sold and to adapt them to the changed requirements. Despite the high quality standard of modern detergents, it has heretofore been tried to further improve the washing power of these detergents in order to solve the constantly increasing environmental problems. Thus the problem of the eutrophication of the lakes and rivers by insufficiently clarified sewage which contains the detergent phosphates and surfactants, makes it necessary to develop new low phosphate or phosphate-free compositions. But reduced environment pollution can also be achieved with detergents which have an improved washing power, compared to commercial products, and, therefore, yield satisfactory washing results, even with reduced concentrations.

The U.S. Pat. to Meyers II et al, No. 3,207,791 describes alkxoylated 2-hydroxy-higher alkylamines having at least six alkoxy units per molecule for use as low-foaming synthetic nonionic detergents. No concurrent use of these higher alkoxylates with anionic detergents is disclosed.

The U.S. Pat. to Wixon, No. 4,049,557 describes 2-hydroxy-higher alkyl-aminoalkyleneamines as fabric softeners compatible with anionic built detergents.

OBJECTS OF THE INVENTION

An object of the present invention is to make the washing results independent of the availability of hot water, for example, from a hot water apparatus or from washing machines with heating devices, so that it is possible both to obtain good washing results and to save heat energy, when only cold water is available.

Another object of the present invention is the development of a detergent for cold temperatures which also leads to a good washing result, with unheated water, hence with water of 10° C. to 30° C., particularly 15° C. to 25° C., which comes generally from the faucet.

Another object of the invention is the development of a surface-active compound combination for use in textile washing agent compositions consisting essentially of (1) at least one tenside selected from the group consisting of anionic surface-active compounds of the sulfonate and sulfate type and nonionic surface-active compounds of the ethoxylated higher alkanols, higher alkenols, higher alkanediols and higher alkylphenols, and (2) at least one hydroxyalkyl compound selected from the group consisting of (A) hydroxyalkyl amines of the formula

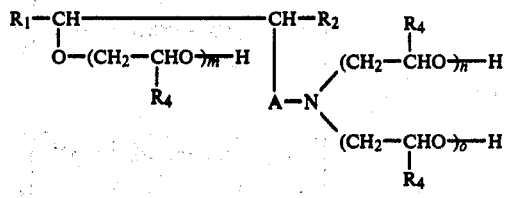

wherein $R_1$ is alkyl having 1 to 16 carbon atoms, $R_2$ is a member selected from the group consisting of hydrogen and alkyl having 1 to 16 carbon atoms, and the sum of the carbon atoms in $R_1+R_2$ is from 6 to 20 with the proviso that when $R_2$ is H, $R_1$ is alkyl having 6 to 16 carbon atoms, $R_4$ is a member selected from the group consisting of hydrogen and methyl, m, n and o represent integers from 0 to 3 and A is a bridging bond selected from the group consisting of:

(a) a single bond between the carbon and the nitrogen, (b)

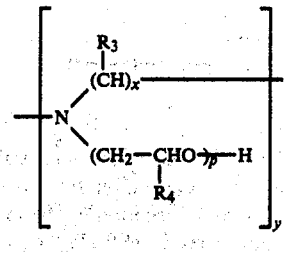

(c)

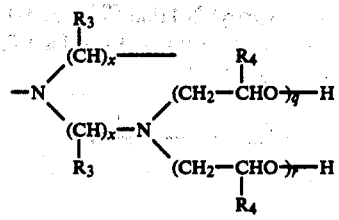

and (d)

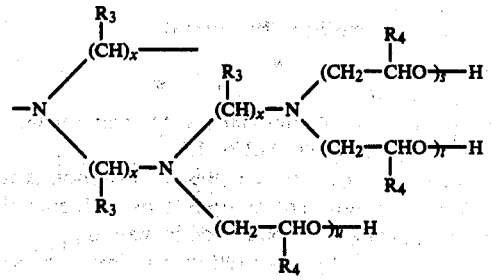

wherein $R_3$ is a member selected from the group consisting of hydrogen and methyl, x is an integer from 2 to 6, Y is an integer from 1 to 3, p, q, r, s, t, and u represent integers from 0 to 3, with the provisos (a) that when A is a single bond between the carbon and the nitrogen, $R_2$ is alkyl having 1 to 16 carbon atoms and m is 0, and (b) that when A is other than a single bond between the carbon and the nitrogen the sum of m to u is from 1 to 5.5, and (B) acylated hydroxyalkyl amines of the formula

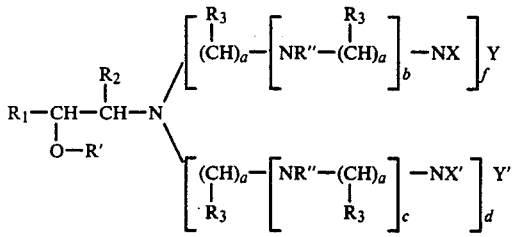

wherein $R_1$, $R_2$ and $R_3$ have the above-assigned values, X and X' are each members selected from the group consisting of hydrogen and

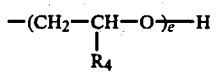

wherein $R_4$ has the above-assigned value and e is an integer from 1 to 3, Y, Y', R' and R'' are each members selected from the group consisting of hydrogen, alkanoyl having from 1 to 12 carbon atoms in the alkane, hydrocarbon aroyl having from 7 to 12 carbon atoms and

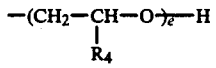

where $R_4$ and e have the above-assigned values, a is an integer from 2 to 6, b is an integer from 0 to 2, c is an integer from 0 to 1, d and f are integers from 0 to 1, with the provisos (d) that at least one of Y, Y', R' and R'' is said alkanoyl or said aroyl, (e) that the sum of b, c, d and f does not exceed 3, (f) that when d and f are 0, Y is said alkanoyl or said aroyl, Y' is

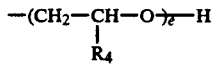

and R' is hydrogen or

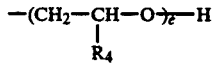

wherein the amount of component (1) to component (2) is in the weight ratio of 100:1 to 1:1.

A yet further object of the present invention is the development of detergent compositions including the above surface-active compound combination.

These and other objects of the present invention will become more apparent as the description thereof proceeds.

DESCRIPTION OF THE INVENTION

The problems of the prior art have been solved and the above objects have been achieved by a detergent which is characterized in that it includes at least one surface-active compound or tenside of the group of anionic, nonionic and zwitterionic surface-active compounds and at least one hydroxyalkyl compound selected from the group consisting of (A) hydroxyalkyl amines of the formula I

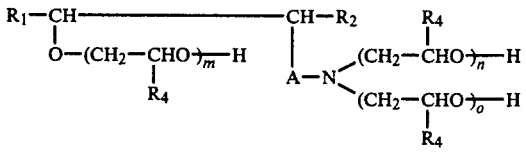

(I)

wherein $R_1$ is alkyl having 1 to 16 carbon atoms, $R_2$ is a member selected from the group consisting of hydrogen and alkyl having 1 to 16 carbon atoms, and the sum of the carbon atoms in $R_1+R_2$ is from 6 to 20, preferably from 8 to 18, with the proviso that when $R_2$ is H, $R_1$ is alkyl having 6 to 16 carbon atoms, $R_4$ is a member selected from the group consisting of hydrogen and methyl, m, n and o represent integers from 0 to 3 and A is a bridging bond selected from the group consisting of:

(a) a single bond between the carbon and the nitrogen,

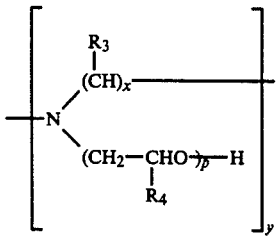

(b)

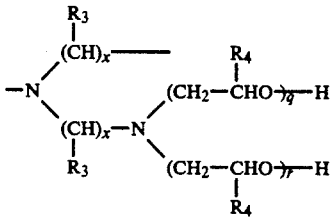

(c)

and

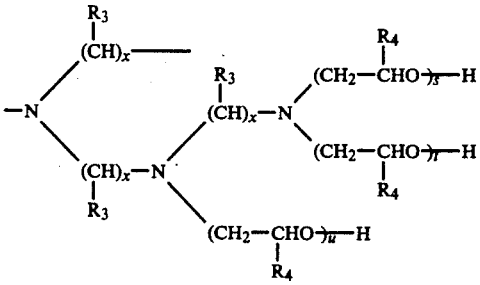

(d)

wherein $R_3$ is a member selected from the group consisting of hydrogen and methyl, x is an integer from 2 to 6, y is an integer from 1 to 3, p, q, r, s, t, and u represent integers from 0 to 3, with the provisos (a) that when A is a single bond between the carbon and nitrogen, $R_2$ is alkyl having 1 to 16 carbon atoms and m is 0, and (b) that when A is other than a single bond between the carbon and the nitrogen, the sum of m to u is from 1 to 5.5 preferably 1 or 2, and (B) acylated hydroxyalkyl amines of the formula II

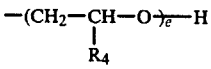

wherein $R_1$, $R_2$ and $R_3$ have the above-assigned values, X and X' are each members selected from the group consisting of hydrogen and $$-(CH_2-\underset{\underset{R_4}{|}}{CH}-O)_e-H$$

wherein $R_4$ has the above-assigned value and e is an integer from 1 to 3, Y, Y', R' and R'' are each members selected from the group consisting of hydrogen, alkanoyl having from 1 to 12, preferably from 1 to 6, and particularly from 1 to 4, carbon atoms in the alkane, hydrocarbon aroyl having from 7 to 12 carbon atoms and $$-(CH_2-\underset{\underset{R_4}{|}}{CH}-O)_e-H$$

where $R_4$ and e have the above-assigned values, a is an integer from 2 to 6, preferably 2 or 3, b is an integer from 0 to 2, c is an integer from 0 to 1, d and f are integers from 0 to 1, with the provisos (d) that at least one of Y, Y', R' and R'' is said alkanoyl or said aroyl, (e) that the sum of b, c, d and f does not exceed 3, (f) that when d and f are 0, Y is said alkanoyl or said aroyl, Y' is $$-(CH_2-\underset{\underset{R_4}{|}}{CH}-O)_e-H$$

and R' is hydrogen or $$-(CH_2-\underset{\underset{R_4}{|}}{CH}-O)_e-H$$

wherein the amount of component (1) to component (2) is in the weight ratio of 100:1 to 1:1, preferably 20:1 to 2:1 and particularly 10:1 to 3:1.

Preferably those hydroxyalkyl amines of formula I and acylated hydroxyalkylamines of formula II are used in the surface-active compound combination and the detergents according to the invention whose turbidity point in water, determined according to DIN 53917, is below 50° C. Hydroxyalkylamines of formula I and acylated hydroxyalkylamines of formula II with this property are those where the sum of the carbon atoms in these formulas of the alkyl groups $R_1$ and $R_2$, and the numerical values for the above-mentioned index numbers m to u and e are correspondingly dimensioned. Generally an increase of the sum of the carbon atoms in $R_1$ and $R_2$, that is, an increase of the alkyl groups, with the same index numbers, leads to a reduction of the turbidity point, and higher numerical values, particularly for m to u and e, respectively, that is, an increase of the number of oxyalkylene groups, particularly of the oxyethylene groups, leads to an increase of the turbidity point. In the case of the acylated hydroxyalkylamine compounds of formula II, the number and size of the alkanoyl and aroyl groups, respectively, also have an effect on the turbidity point.

It was found surprisingly that only a small amount of the hydroxyalkylamines of formulas I and II with this property already causes a synergistic increase of the washing power in the surface-active compound combinations and the detergents according to the invention.

The combination of surfactant or surfactant mixture with the hydroxyalkylamines of formula I and/or II which comprise the surface-active compound combinations are present in the detergents according to the invention generally in an amount of 5% to 50% by weight.

In the detergents according to the invention, the tenside or tenside mixture is present in excess relative to the hydroxyalkylamine, as defined above, sometimes in equal amounts. The detergents contain in addition at least one other conventional detergent component from the group of the inorganic and/or organic builder substances, and, optionally, a bleaching component, foam inhibitors, optical brighteners, soil suspension agents, enzymes, antimicrobial agents, perfumes and colorants. Liquid detergent compositions can contain, instead of water, other liquid carriers, like low-molecular-weight organic solvents which are miscible with water, particularly from the group of the alkanols, alkanediols, and ether alcohols, such as alkoxyalkanols. These additional detergent components are mostly present in amounts of 5% to 95% by weight.

The detergent can be formulated according to the invention to perform the usual washing operation with good results by hand and in washing machines with cold water as it is directly available from the faucet. The preparations according to the invention can also contain bleaching additives, consisting of peroxy-compounds as active oxygen carriers, particularly sodium perborate, stabilizers, and, optionally, activators, so that an additional bleaching effect is achieved when washing at higher temperatures, that is, at 60° C. or at boiling temperatures. When washing at these higher temperatures in the washing machine, the hydroxyalkylamine used according to the invention also contributes in an advantageous manner to the total washing effect. In order to achieve a good washing result, the high or full temperature range detergents according to the invention can, therefore, be utilized with relatively low concentrations, or compositions can be formulated with a clearly reduced phosphate content, which results in less stress on sewage disposed plants.

The composition of the detergents according to the invention is subject to certain fluctuations, depending on the intended use. If the preparations according to the invention are formulated to be universally applicable so that they can also be used at high temperatures, this can be achieved by the addition of a peroxy compound, particularly sodium perborate, which together with a stabilizer, and optionally, an activator for the peroxy compound, can amount to 10% to 40%, particularly 15% to 35%, by weight of the total detergent.

The composition of the detergent according to the invention is generally in the range of the following formula:

(a) 5% to 50%, preferably 5% to 25%, by weight of at least one surface-active compound from the group of the sulfonate tensides, or the polyglycol ether sulfate tensides or the nonionic tensides of the type of the ethoxylated alkanols, alkenols and alkylphenols, (b) 0.1% to 5%, preferably 0.3% to 3%, by weight of a hydroxyalkylamine of the above-defined formula I and/or an acylated hydroxyalkylamine of formula II, where the components (a) and (b) are present preferably in a ratio of 20:1 to 2:1, (c) 0 to 8%, preferably 0.2% to 5%, by weight of a foam inhibitor from the group of the alkali metal soaps of substantially $C_{18}$ to $C_{22}$ fatty acids and the non-surface-active foam inhibitors, (d) 50% to 94.9%, preferably 55% to 90%, by weight of powdery and/or liquid carrier substances from the group of the powdery organic and inorganic builder salts, of the water-soluble lower alkanols, alkanediols and ether alcohols and of water, optionally including a bleaching component, and (e) 0 to 10%, preferably 0.5% to 10%, by weight of ordinary additives for detergents from the group of the optical brighteners, enzymes, soil suspension agents, textile fabric softeners, antimicrobial agents, perfumes and dyes.

More particularly, the detergent composition according to the invention is a washing agent composition for textiles consisting essentially of (a) from 5.1% to 55% by weight of the surface-active compound composition of the invention wherein component (1) is present in an amount of 5% to 50% by weight of the washing agent composition and component (2) is present in an amount of from 0.1% to 5% by weight of the washing agent composition and the weight ratio of component (1) to component (2) is from 20:1 to 2:1, (b) from 0 to 8% by weight of a foam inhibitor selected from the group consisting of alkali metal soaps by higher fatty acids, at least 50% of which have from 18 to 22 carbon atoms, and the non-surface-active foam inhibitors, (c) from 50% to 94.9% by weight of powdery or liquid carriers for surface-active components selected from the group consisting of powdery inorganic builder salts, powdery organic builder salts, water-soluble lower alkanols, water-soluble lower alkanediols, water-soluble alkoxyalkanols, water-soluble alkoxyalkoxyalkanols, water, with the proviso that up to 40% by weight of the total composition of said powdery inorganic and organic builders salts can be replaced by bleach components, (d) from 0 to 10% by weight of at least one further additive of the type: optical brighteners, enzymes, soil suspension agents, textile fabric softeners, antimicrobial agents, dyes and perfumes.

Detergents according to the invention which have a pronounced washing power both at low elevated and boiling temperature, contain as tenside components (1) an anionic surface-active compound of the sulfonate type in combination with a nonionic surface-active compound, especially one of the type of the ethoxylated aliphatic $C_{10}$–$C_{20}$ alcohols. Preparations according to the invention whose tenside components (1) consists exclusively of nonionic surface-active compounds, particularly of ethoxylated aliphatic $C_{10}$–$C_{20}$ alcohols, are likewise preferred.

A particularly good washing effect is achieved if these nonionic ethoxylation products are used as mixture of products with a different average degree of ethoxylation and the ratio of the addition products of 8 to 20 mols of ethylene oxide onto 1 mol of an aliphatic $C_{10}$–$C_{20}$ alcohol in this mixture to the ethoxylation products with 2 to 7 mols of ethylene alcohol per mol of alcohol is 5:1 to 1:3.

Detergents according to the invention with low foaming properties contain from 0.2% to 0.8% by weight of a non-surface-active foam inhibitor or 0.5% to 5% by weight of an alkali metal soap of substantially $C_{18}$–$C_{22}$ fatty acids, or a mixture of the non-surface-active foam inhibitor and of the soap in an amount of 0.2% to 5% by weight.

The detergents according to the invention are formulated as powdery, pasty or liquid preparations. In the case of the powdery preparations, the carrier substances consist mostly of powdery organic and inorganic builder salts which can be water-soluble or water-insoluble, and which consist at least partly of substances which have a sequestering and/or precipitating effect on the hardness-formers of water. The "powdery carrier substances" or "builder salts" under the present definition also include the active oxygen-supplying bleaching component if any, as well as inert water-soluble inorganic salts such as sodium sulfate.

The production of the pourable powdery detergents according to the invention can be effected according to known methods, for example, by cold and hot spray drying. Preferably the hydroxyalkylamines (2), which are partly liquid or pasty at room temperature, are applied on the powdery particles of the remaining components of the preparations, preferably by spraying on a part of the builder salts. For this purposes, forms of sodium tripolyphosphate and sodium sulfate with bulk densities of 200 to 500 gm/l. are particularly suitable. In the case of bleach-containing preparations, the component (2) is applied by spraying-on finely powdered sodium perborate. Particularly for the production of tricklable, powdery detergents with a high portion of ethoxylated aliphatic alcohols, especially those with an average degree of ethoxylation of 2 to 7, whose pronounced water vapor volatility is known, but which, on the other hand, are characterized by good biodegradability, the method of hot spraying of an aqueous slurry of the components, including the nonionic surface-active compounds, is less suitable. In addition to the method of spraying-on the hydroxyalkylamines (2), optionally together with other heat and hydrolysis sensitive detergent components, on to the other components present in powder form, this method also employing the spraying-on of the nonionic tensides on to a powder produced by hot-spraying of the heat-resistant preparation components, with the simultaneous or subsequent addition of the powdered bleaching component, must be considered the production method of choice.

The mixing of the nonionic tensides and of other sensitive components of the detergent according to the invention, if any, with the above-mentioned powder types is effected preferably in a continuous mixer with mixing arms rotating about a vertical axis, particularly with a continuous mixer by Schuurmans & van Ginneken, Amsterdam, of the Schugiflexomix ® type.

The liquid to pasty preparations are preferably so produced that the tenside component (1) is dissolved in the solvent, (c), then the hydroxyalkylamine (2) is added, and the mixtures are homogenized by stirring and heating, if necessary, and additional components (b) and (d) if any, and finally powdered builder salts according to (c) are added.

The hydroxyalkylamines of formula I according to the invention are primarily compounds which were produced in a single- or two-stage reaction from terminal or non-terminal epoxy alkanes by reacting them at first with a mono- or diethanol amine, with a mono- or diisopropanol amine, with ammonia, with an alkylene diamine, with a polyalkylene polyamine, or with a hydroxyalkyl polyamine, and partly ethoxylating and/or propoxylating these addition products in the second stage. Preferred are ethoxylated products, that is, compounds where $R_4$ denotes hydrogen.

The epoxy alkane used as a starting material is obtained in known manner from the corresponding olefins or olefin mixtures, respectively. The non-terminal epoxy alkanes are obtained, for example, by epoxidizing olefin mixtures which were obtained by catalytic dehydrogenation or by chlorination-dehydrochlorination of linear paraffins and selective extraction of the desired monoolefins. Monoolefins with non-terminal double bond can also be produced by isomerization of α-olefins.

The α- or 1,2-epoxy alkanes are produced from α-monoolefins which are obtained, for example, by polymerization of ethylene with organic aluminum compounds as catalysts, or by thermal cracking of paraffin wax. Preferred are monoolefins with chain lengths in the range $C_{12}$ to $C_{18}$ for the production of the hydroxyalkylamines of Formula I.

Preferred non-terminal monoolefins of a $C_{11}$ to $C_{14}$ fraction and of a $C_{15}$ to $C_{18}$ fraction had the following chain length distribution:

$C_{11}$ TO $C_{14}$ FRACTION $C_{11}$-olefins about 22% by weight
$C_{12}$-olefins about 30% by weight
$C_{13}$-olefins about 26% by weight
$C_{14}$-olefins about 22% by weight $C_{15}$ TO $C_{18}$ FRACTION $C_{15}$-olefins about 26% by weight
$C_{16}$-olefins about 35% by weight
$C_{17}$-olefins about 32% by weight
$C_{18}$-olefins about 7% by weight The hydroxyalkylamines of Formula I, which represent the derivatives of alkylene diamines, polyalkylene polyamines or hydroxyalkyl polyamines, are the reaction products of the terminal and non-terminal epoxyalkanes with ethylene diamine, propylene diamine, trimethylene diamine, tetramethylene diamine, pentamethylene diamine, hexamethylene diamine, or diethylene triamine or triethylene tetramine or hydroxyethyl- or hydroxyisopropylethylene diamine. These hydroxyalkyl amines are represented by Formula Ia.

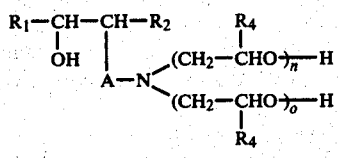

(Ia)

wherein $R_1$, $R_2$, $R_4$, A, n and o have the above-assigned values.

These addition products can also be reacted in the second stage with a $C_2$ or $C_3$-alkylene oxide, preferably with ethylene oxide.

In the derivatives of the non-terminal epoxy alkanes, Formula I comprises particularly the compounds obtained in a single stage reaction, if A denotes a simple valence, by the addition of mono- or diethanolamine, or mono- or diisopropanolamine, or of the corresponding mono- or bis-hydroxyalkoxyalkyl amines, or of the mono- or bis-hydroxyalkoxy-alkyloxyalkyl amines, or of ammonia, These adducts can be additionally ethoxylated or propoxylated. The resulting hydroxyalkylamines thus correspond to Formula Ic:

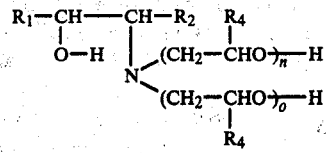

(Ic)

wherein $R_1$ and $R_2$ are alkyl having from 1 to 16 carbon atoms and the sum of the carbon atoms in $R_1+R_2$ is in the range of 6 to 20, preferably 8 to 18, $R_4$ denotes hydrogen or methyl, and where n and o have the numerical values 0 or 1 to 3, preferably the sum of n+o corresponds at least to the value 1.

Particularly suitable as components of main or full-range detergents with reduced phosphate content are the products of Formula Ic, where the sum of the index numbers n and o is at least 1, and has particularly a numerical value between 2 and 5, and where $R_4$ represents hydrogen. These substances combine high synergistic washing activity with very low water vapor volatility, which plays, as known a great part in the production of detergents according to the hot spray-drying method.

The products of Formula Ic, particularly the preferred types, are obtained either by reacting the epoxy alkane

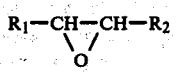

with the primary or secondary amine

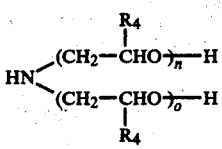

where the substituents and index numbers in these formulas have the same meaning as in Formula Ic or by ethoxylation or propoxylation of the adducts produced in the first stage from the epoxy alkanes with mono- or dialkanol amines under alkaline conditions, where the alkoxylation does not take place on the β-hydroxyl. Products with $R_4$=hydrogen are preferred.

The hydroxyalkyl amines of Formula I (or Formula Ia and Ic) represent as a rule mixtures on the basis of their structure, and mode of formation. Thus the position of the vicinal substituents is distributed over the entire chain in the derivatives of non-terminal epoxy alkanes, which are mostly fractions of a certain chain length range. Furthermore, mixtures are formed in the reaction of the epoxy alkanes with the polyamines, because these polyamines can react with one of their primary or secondary amine groups. Finally the alkoxylation also leads necessarily to product mixtures.

The acylated hydroxyalkylamines of Formula II used according to the invention likewise are derived from terminal or non-terminal epoxyalkanes. They are obtained primarily by reacting the epoxyalkanes first with a 1 to 10 molar excess of an alkylene diamine or polyalkylene polyamine, and reacting the resulting β-hydroxyalkylamino compounds in a second stage at 50° C. to 250° C. with at least 1 mol of an acylating agent, preferably an acylating agent containing an alkanoyl group with 1 to 4 carbon atoms in the alkane, from the group of the carboxylic acid anhydrides, carboxylic acid halides, carboxylic acid amides and carboxylic acid esters, preferably a carboxylic acid anhydride or carboxylic acid amide.

Among the effective substances of Formula II which can be used according to the invention are also compounds which have been ethoxylated and/or propoxylated after the acylation step. This alkoxylation in a third stage can be so controlled in known manner that it takes place on the primary and secondary amine groups with insertion of mono or polyoxyalkylene groupings, or these amine groups as also the $\beta$-hydroxyl groups and primary amido groups can be substituted by mono or polyoxyalkene groups.

The acylated hydroxyalkylamines thus produced are also represented by the following Formula IIa:

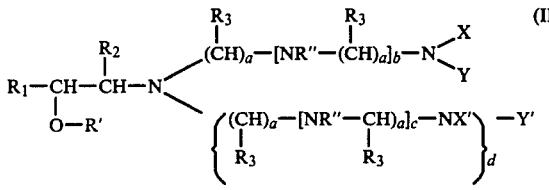

(IIa)

wherein $R_1$ is alkyl having 1 to 16 carbon atoms, $R_2$ is a member selected from the group consisting of hydrogen and alkyl having 1 to 16 carbon atoms, and the sum of the carbon atoms in $R_1+R_2$ is from 6 to 20, preferably 8 to 18, with the proviso that when $R_2$ is H, $R_1$ is alkyl having 6 to 16 carbon atoms, $R_3$ is a member selected from the group consisting of hydrogen and methyl, X and X' are independently members selected from the group consisting of hydrogen and

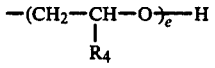

wherein $R_4$ is a member selected from the group consisting of hydrogen and methyl and e is an integer from 1 to 3, Y, Y', R' and R'' are members selected from the group consisting of hydrogen, alkanoyl having 1 to 4 carbon atoms in the alkane, and

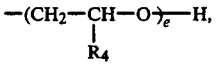

a is an integer from 2 to 6, preferably 2 or 3, b is an integer from 0 to 2, c and d are integers from 0 to 1, with the proviso that at least one of Y, Y', R' and R'' is said alkanoyl and the sum of b, c and d does not exceed 3. If the alkoxylation stage was omitted in the production of the compounds of formula IIa, then these are products where the substituents X and X' are hydrogen, and the substituents R', R'' and Y and Y' are hydrogen or the alkanoyl group.

Formula II also comprises acylated hydroxalkylamines to be used according to the invention, which are obtained by reacting a terminal or non-terminal epoxyalkane with a carboxylic acid amide and subsequent ethoxylation and/or propoxylation, the ethoxylated products being preferred. Such compounds correspond to formula II, if the index numbers d and f have the value 0, that is, these compounds are represented by Formula IIb

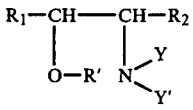

(IIb)

wherein $R_1$ and $R_2$ are members selected from the group consisting of hydrogen and alkyl having 1 to 16 carbon atoms, the sum of the carbon atoms in $R_1+R_2$ is from 6 to 20, preferably 8 to 18 with the proviso that where one of $R_1$ or $R_2$ is hydrogen, the other of $R_1$ or $R_2$ is alkyl having 6 to 16 carbon atoms, Y is a member selected from the group consisting of alkanoyl having 1 to 12 preferably 1 to 6 carbon atoms in the alkane and hydrocarbon aroyl having from 7 to 12 carbon atoms, Y' is

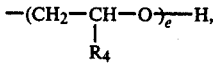

and R' is is a member selected from the group consisting of hydrogen and

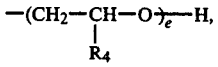

where $R_4$ is a member selected from the group consisting of hydrogen and methyl and e is an integer from 1 to 3.

The above described method of production of the compounds of Formula IIb is recommended particularly for terminal epoxyalkanes as starting materials. In addition, and particularly in the case of the non-terminal epoxyalkanes as starting materials, the hydroxyalkylamines of Formula IIb can also be obtained through the addition of the nitrile corresponding to the carboxylic acid amide onto the epoxyalkane with subsequent saponification to the amide and ethoxylation. Another production method starts from the reaction product of the epoxyalkane with ammonia, which is acylated with an acid halide to the amide. The production methods with acetamide or acetonitrile are preferred.

For use as high-temperature detergents, which are also called full-range or coarse detergents, compositions are particularly suitable which have a reduced detergent phosphate content compared to the products presently on the market.

These detergents are based on the two types of nonionic surface-active compounds, a foam inhibiting soap, condensed phosphates, and peroxy compounds, particularly perborates and they are characterized in that they have the following composition:

(a) 5% to 15%, preferably 5.5% to 12% by weight of a nonionic surface-active component consisting of
   1. A nonionic surface-active compound produced by condensation of 1 mol of an aliphatic $C_{10}$ to $C_{20}$ alcohol with 2 to 7 mols of ethylene oxide and
   2. A nonionic surface-active compund produced by condensation of 1 mol of an aliphatic $C_{10}$ to $C_{20}$ alcohol with 8 to 20 mols, particularly 9 to 15 mols of ethylene oxide, with a proportion of (a1); (a2) of 3:1 to 1:1, preferably 2.4:1 to 1.1:1.

(b) 0.5% to 3.5%, preferably 1% to 2.5% by weight of a hydroxyalkylamine of the above-defined Formula I, where the proportion of the nonionic surface-active component (a) to hydroxyalkylamine (b) is in the range of 20:1 to 2:1, preferably 10:1 to 3:1, (c) 0.5% to 3.5%, preferably 1% to 2% by weight of a foam inhibiting soap, consisting of over 50% by weight of alkali metal soaps of saturated $C_{18}$ to $C_{22}$ fatty acids, (d) 15% to 35%, preferably 20% to 30% by weight of a condensed alkali metal phosphate, particularly sodium tripolyphosphate.

(e) 0 to 30%, preferably 0.1% to 20% by weight of additional particularly phosphorus-free organic and/or inorganic builder salts, (f) 10% to 40%, particularly 18% to 30% by weight of a bleaching component, consisting of a peroxy compound, particularly sodium perborate tetrahydrate, and optionally stabilizers and/or activators for the peroxy compounds, (g) 0 to 30%, preferably 0.5% to 10% by weight of other customary detergent ingredients from the group of the soil suspension agents, enzymes, optical brighteners, antimicrobial agents, textile fabric softeners, dyes and perfumes, and bound water.

In these compositions with a reduced phosphate content, the hydroxyalkylamines (b) of the above-defined Formula Ic, where $R_4$ is hydrogen and the sum of the index numbers n and o represent a numerical value between 2 and 5 are particularly suitable.

Preferred embodiments of the detergent with a reduced phosphate content according to the invention contain the condensed alkali metal phosphate according to the above-defined component (d) together with the other builder substances according to the above-defined component (e) in the form of a combination which consist of (d1) 20% to 30% by weight of sodium tripolyphosphate (e1) 0.1% to 1% by weight of organic sequestrants for calcium and especially heavy metal ions, and (e2) 2% to 20% by weight of wash alkalies, particularly sodium silicates and/or sodium sulfate, and which is present together with the tenside combination from components (a), (b) and (c) according to the foregoing definition.

While the special advantage of the above-defined high-temperature detergents with a reduced phosphate content is seen in the fact that they contribute to a reduction of the phosphate content in the sewage, another advantage of the preparation according to the invention, particularly of those without perborate, is their usability under cold washing conditions.

The invention concerns therefore furthermore a method for washing textiles by using the detergents according to the invention. This method is characterized in that the textiles are moved manually or mechanically in an aqueous wash liquor at a temperature between 10° C. and 30° C., preferably 15° C. to 25° C. for 10 to 60 minutes. The wash liquor contains the above-defined detergent in amounts of 1.0 gm/l to 12.0 gm/l, preferably 4.0 to 10.0 gm/l, and the textiles are subsequently removed from the wash liquor and rinsed with fresh water until the detergent components have been completely removed.

The following are the most important ingredients contained in the detergents according to the invention, listed according to substance classes.

The tenside, which are contained in the detergents according to the invention in combination with the hydroxyalkylamines of Formula I and II, have in the molecule at least one hydrophobic organic moiety and one water-solubilizing, anionic, nonionic or amphoteric group. The hydrophobic moiety is mostly an aliphatic hydrocarbon radical with 8 to 26, preferably 10 to 22 and particularly 12 to 18, carbon atoms or an alkyl aromatic radical, such as alkylphenyl with 6 to 18, preferably 8 to 16, aliphatic carbon atoms.

Among the anionic surface-active compounds are, for example, soaps of natural or synthetic, preferably saturated fatty acids, optionally also, soaps of resinic or naphthenic acids. Suitable synthetic anionic tensides are those of the type of the sulfonates, sulfates and synthetic carboxylates.

The surfactants of the sulfonate type which can be used are the alkylbenzene sulfonates ($C_{9-15}$alkyl), mixtures of alkene and hydroxyalkane sulfonates, as well as disulfonates, as they are obtained, for example, from monoolefins with terminal or non-terminal double bond by sulfonation with gaseous sulfur trioxide and subsequent alkaline or acid hydrolysis of the sulfonation products. Also suitable are alkane sulfonates which are obtained from alkanes by sulfochlorination or sulfoxidation and subsequent hydrolysis or neutralization or by the addition of a bisulfite onto olefins. Other suitable surfactants of the sulfonate type are the esters of $\alpha$-sulfo-fatty acids, e.g., the $\alpha$-sulfonic acids from hydrogenated methyl or ethyl esters of coconut, palm kernel, or tallow fatty acid.

Suitable tenside of the sulfate type are particularly the sulfuric monoesters of the aliphatic primary alcohols ethoxylated with 1 to 6 mols of ethylene oxide (e.g. from coconut alcohols, tallow fat alcohols, or oleyl alcohols) or ethoxylated secondary alcohols or alkylphenols. Also suitable are sulfated fatty acid alkanolamides and sulfated fatty acid monoglycerides, as well as the sulfated aliphatic primary alcohols, if they are present together with sulfonate tensides and/or ethoxylated alcohols. Other suitable anionic tensides are the fatty acid esters or fatty acid amides of hydroxycarboxylic acids or aminocarboxylic acids or the corresponding sulfonic acids, such as fatty acid sarcosides, fatty acid glycolates, fatty acid lactates, fatty acid taurides or fatty acid isoethionates.

The anionic tensides can be present in the form of their sodium, potassium, and ammonium salts, as well as soluble salts of organic bases, such as mono, di or triethanolamine.

Suitable nonionic surface-active compounds of the type of the aliphatic polyoxyethylene glycol monoethers are particularly the addition products of 1 to 40, preferably 2 to 20 mols of ethylene oxide onto 1 mol of a $C_{10}$ to $C_{20}$ compound from the group of the alcohols, such as alkanols and alkenols, alkylphenols, alkanoic acids, fatty alkylamines, alkanoic acid amides, alkenoic acid amides or alkanesulfonamides. Particularly important are the addition products of 8 to 20 mols of ethylene oxide onto primary alochols, such as onto coconut fatty alcohols or tallow fatty alcohols, onto oleyl alcohol, onto oxoalcohols, or onto secondary alkanols with 8 to 18, preferably 12 to 18 carbon atoms, as well as onto mono or dialkylphenols with 6 to 14 carbon atoms in the alkyl radicals. In addition to these water-soluble nonionics, polyglycol ethers with 2 to 7 mols of oxyethylene radicals in the molecule which are not completely soluble in water, are also of interest, particularly if they are used together with water-soluble nonionic or anionic tensides. Of greater practical interest, because of their good biodegradability, are particularly the ethoxylation products of primary alkanols and alkenols.

Sources for the alcohols are particularly the readily accessible alcohols from natural fats, such as coconut fatty alcohol with substantially $C_{12/14}$-alkyl radicals, and tallow fatty alcohol mainly with $C_{16/18}$ alkyl and alkenyl radicals. Also suitable are derivatives of the so-called oxoalcohols obtained from olefins by hydroformylation and hydrogenation, the primary aliphatic alcohols with a degree of a-methyl branching that does not impair the biodegradability, as well as the secondary alkanols obtained by partial oxidation of paraffins with the secondary hydroxyl group distributed over the hydrocarbon chain. Also suitable are the ethoxylation products of terminal and non-terminal alkane diols.

Typical representatives of the nonionic surfactants to be used according to the invention with an average degree of ethoxylation of 2 to 7 are, for example, coconut fatty alcohol 3-EO (EO=ethylene oxide), tallow fatty alcohol 5-EO, oleyl/cetylalcohol 5-EO(iodine number 30-50), tallow fatty alcohol 7-EO, synth. $C_{12}$ to $C_{16}$ fatty alcohol 6EO, $C_{11}$ to $C_{15}$ oxoalcohol 3-EO, $C_{14}/C_{15}$ oxoalcohol 4-EO, i-$C_{15}$–$C_{17}$ alkane diol 5-EO (i=non-terminal) sec.-$C_{11}$ to -$C_{15}$ alkane diol 4-EO.

Representatives of the nonionic tensides to be used according to the invention with an average degree of ethoxylation of 8 to 20, particularly 9 to 15, are, for example, coconut fatty alcohol 12 EO, synth. $C_{12/14}$ fatty alcohol 9-EO, oleyl/cetylalcohol 10-EO, tallow fatty alcohol 14-EO, $C_{11}$ to $C_{15}$ oxoalcohol 13-EO, $C_{15}$ to $C_{18}$ oxoalcohol 15-EO, i-$C_{15}$ to $C_{17}$ alkane diol 9-EO, $C_{14}/C_{15}$-oxoalcohol 9-EO, sec. $C_{11}$ to $C_{15}$ alcohol 9-EO.

Also suitable as nonionic tensides are the water-soluble addition products of ethylene oxide onto polyoxypropylene glycol, alkylene diamine polyoxypropylene glycol, and alkylpoloxypropylene glycols with 1 to 10 carbon atoms in the alkyl chain, containing 20 to 250 oxyethylene units and 10 to 100 oxypropylene groups, in which the polyoxypropylene glycol chain acts as a hydrophobic radical.

Nonionic surfactants of the type of the amineoxides or sulfoxides can also be used, for example, the compounds:

N-cocoalkyl-N,N-dimethyl aminoxide

N-hexadecyl-N,N-bis-(2,3-dihydroxypropyl)-aminoxide

N-tallow alkyl-N,N-dihydroxylethyl aminoxide.

The term "nonionic tensides" (nonionics) thus does not comprise the hydroxyalkylamines of Formula I and the acylated hydroxyalkylamines of Formula II according to the invention.

The amphoteric or zwitterionic surface-active compounds (tensides) are preferably derivatives of aliphatic quaternary ammonium compounds where one of the aliphatic radicals consists of a $C_8$ to $C_{18}$ radical and another contains an anionic water-solubilizing carboxy group, sulfo group or sulfato group. Typical representatives of such surface-active betaines are the compounds:

3-(N-hexadecyl-N,N-dimethyl-ammonio)-propane sulfate 3-(N-tallow alkyl-N,N-dimethyl-ammonio)-2-hydroxypropane sulfonate 3-(N-hexadecyl-N,N-bis-[2-hydroxyethyl]-ammonio)-2-hydroxypropyl sulfate 3-(N-cocoalkyl-N,N-bis-[2,3-dihydroxypropyl]-ammonio)-propane sulfonate N-tetradecyl-N,N-dimethyl-ammonio-methane carboxylate N-hexadecyl-N,N-bis-(2,3-dihydroxy-propyl)-ammonio-methane carboxylate.

The foaming properties of the tensides can be increased, or reduced, by combining different types of tensides. A reduction can also be achieved by adding nonsurface-active organic substances. A reduced foaming property, which is desirable when working in washing machines, is frequently achieved, by combining different types of tensides, for example, sulfate and/or sulfonates with nonionics and/or with soaps. The foam inhibiting effect of the soaps increases with the degree of saturation and the carbon number of the fatty acid radical. Suitable as foam inhibiting soaps are therefore soaps of natural or synthetic origin which have a high portion of $C_{18}$ to $C_{22}$ fatty acids, e.g. the derivatives of hydrogenated train oils and rape oils. In practice, fatty acid mixtures with a chain length distribution of $C_{12}$ to $C_{22}$ are mostly used. By "soaps of fatty acids with substantially $C_{18}$ to $C_{22}$ carbon atoms" we understand here soaps which consist of at least 50% by weight $C_{18}$ to $C_{22}$ fatty acid salts. The combination of foam inhibiting soaps with non-surface-active foam inhibitors is particularly suitable for regulating the foaming in the washing machine during the washing proper as well as during the rinsing of the wash liquor.

In the case of the compositions with reduced phosphate content according to the invention whose surfactant component consists of nonionic tensides, it was found that for regulating foam for the entire temperature range in conventional drum-type washing machines, particularly for the high-temperature range, as well as for preventing the formation of residual foam in the rinsing cycles, a small amount of a soap which consists of the alkali metal salt of saturated fatty acids (iodine number=5), with the chain length distribution $C_{12}$ to $C_{22}$ where the portion of the fatty acids with the chain length $C_{18}$ to $C_{22}$ of this soap is at least 50% by weight, suffices as a foam inhibitor. These foam inhibiting soaps can be produced, for example, from the corresponding cuts of the hardened fatty acids of rape oil, from hardened train oil, if necessary in mixture with hardened tallow fatty acids and other vegetable and animal fatty acid sources with a high portion of $C_{18}$ and longer chain fatty acids.

The non-surface-active foam inhibitors used alone or in combination with the foam inhibiting soaps are generally water-insoluble compounds containing mostly aliphatic $C_8$ to $C_{22}$ carbon radicals. Preferred non-surface-active foam inhibitors for the preparation according to the invention are the N-alkylaminotriazines, that is, reaction products of 1 mol of cyanuric chloride with 2 to 3 mols of a mono- or dialkylamine with substantially 8 to 18 carbon atoms in the alkyl. Also suitable are the propoxylated and/or butoxylated aminotriazines, for example, the reaction products of 1 mol of melamine with 5 to 10 mols of propylene oxide and an additional 10 to 50 mols of butylene oxide; as well as the aliphatic $C_{18}$ to $C_{40}$ alkanones, such as stearone, the fatty ketones from hardened train oil fatty acids and tallow fatty acids, etc. Also suitable are the paraffins and haloparaffins with melting points below 100° C. as well as polymeric silicon-organic compounds of the type of silicone oils.

The water-soluble organic and inorganic builder salts are suitably weakly acid, neutral or alkaline reacting salts, particularly alkali metal salts. The water-soluble alkali metal metaphosphates or alkali metal polyphosphates, particularly pentasodium tripolyphosphate, are of particular importance, in addition to the alkali metal orthophosphates and alkali metal pyrophosphates. These phosphates can be replaced partly or completely by water-insoluble inorganic sequestrants and/or by organic sequestrants for calcium-ions.

The organic sequestrants comprise compounds of the type of the aminopolycarboxylic acids, such as nitrilotriacetic acid, ethylenediaminetetraacetic acid, diethylenetriamine pentaacetic acid, as well as higher homologs. Suitable phosphorus containing organic sequestrants are the water-soluble salts of the alkane polyphosphonic acids, aminoalkanepolyphosphonic acids and hydroxyalkane polyphosphonic acids and phosphonopolycarboxylic acids, such as methane diphosphonic acid, dimethylaminomethane-1,1-diphosphonic acid, aminotri-(methylene phosphonic acid), 1-hydroxyethane-1,1-diphosphonic acid, 1-phosphonoethane-1,2-dicarboxylic acid, 2-phosphonobutane-1,2,4-triacarboxylic acid. Among the organic builder salts are the nitrogen-free and phosphorus-free polycarboxylic acids forming complex salts with calcium ions. These also include the polymers containing carboxyl groups. Suitable compounds of the polycarboxylic acid type are citric acid, tartaric acid, benzenehexacarboxylic acid, and tetrahydrofurane tetracarboxylic acid. Polycarboxylic acids containing ether groups, can also be used, such as 2,2'-oxydiscuccinic acid, as well as polyvalent alcohols partly or completely etherified with glycolic acid, or hydrocarboxylic acid, such as bis-carboxymethylethylene glycol, carboxymethyloxyscuccinic acid, carboxymethyl tartronic acid, and carboxymethylated or oxidized polysaccharides. Also suitable are the polymeric carboxylic acids with a molecular weight of at least 350 in the form of the water-soluble salts, such as polyacrylic acid, poly-α-hydroxyacrylic acid, polymaleic acid, as well as the copolymers of the corresponding monomeric carboxylic acids with each other or with ethylenically unsaturated compounds, like ethylene, propylene, isobutylene, vinyl ethyl ether or furan. Also suitable as water-insoluble inorganic builder salts are the finely divided, synthetic water-insoluble silicates described more fully in U.S. Patent application Ser. No. 458,306, filed Apr. 5, 1974, now abandoned in favor of continuation Ser. No. 800,308, filed May 25, 1977, as phosphate substitutes for washing and cleaning agents, having a calcium-binding power of at least 50 mg CaO/gm of anhydrous active substance and having the formula, combined water not shown $$(M_{2/n}O)_x \cdot Me_2O_3 \cdot (SiO_2)_y$$

where M is a cation of the valence n, exchangeable with calcium, x is a number of from 0.7 to 1.5, Me is aluminum or boron, and y is a number from 0.8 to 6.

The preferred calcium-binding capacity, which is in the range of 100 to 200 mg CaO/gm AS and mainly about 100 to 180 mg CaO/gm AS, is found principally in compounds of the following composition:

$$0.7\text{–}1.1\ Na_2O \cdot Al_2O_3 \cdot 1.3\text{–}3.3\ SiO_2.$$

This formula includes two different types of crystal structures (or their non-crystalline precursors) that differ also in their formulas:

$$0.7\text{–}1.1\ Na_2O \cdot Al_2O_3 \cdot 1.3\text{–}2.4\ SiO_2 \qquad (a)$$

$$0.7\text{–}1.1\ Na_2O \cdot Al_2O_3 \cdot >2.4\text{–}3.3\ SiO_2. \qquad (b)$$

The different crystal structures become apparent in the x-ray diffraction diagram. The particle size of these aluminosilicates is substantially below 40μ, and particularly in the range of 10–0.1μ, and the calcium binding power characterizing the aluminosilicates is effective within 15 minutes according to a test indicated in the prior art.

The "wash-alkalis", which are contained particularly in the above-defined compositions with a reduced phosphate content and nonionic tenside component, and which can be contained in the other compositions, are the nonsequestering salts of the bicarbonates, carbonates, borates, sulfates or silicates of the alkali metals, particularly of sodium. Sodium silicates with a ratio of $Na_2O:SiO_2$ of 1:1 to 1:3.5 are particularly suitable.

Other builder salts which are used because of their hydrotropic properties mostly in liquid detergents are the salts of the surface-active sulfonic acids, carboxylic acids, and sulfocarboxylic acids containing 2 to 9 carbon atoms, for example, the alkali metal salts of alkanesulfonic acids, benzenesulfonic acids, toluenesulfonic acids, xylenesulfonic acids or cumene sulfonic acids, as well as the sulfobenzoic acid, sulfophthalic acid, sulfoacetic acid, sulfosuccinic acid, and the salts of acetic or lactic acid. Acetamide or urea can also be employed as solution acids.

The preparations can also contain soil suspensions agents which suspended the soil detached from the fiber in the liquor and thus prevent greying. Suitable for this purpose are water-soluble colloids of a mostly organic nature, such as the water-soluble salts of polymeric carboxylic acids, glue, gelatin, salts of ether-carboxylic acids, or ether-sulfonic acids of starch or cellulose or salts of acid sulfuric esters of cellulose or starch. Water-soluble polyamides containing acid groups are also suitable for this purpose. Furthermore soluble starch preparations and other than the above-mentioned starch products can also be used, e.g. degraded starch, aldehyde starches, e.g. polyvinyl pyrrolidone can also be used.

Among the active oxygen carriers serving as bleaching agents, which supply $H_2O_2$ in water, sodium perborate tetrahydrate ($NaBO_2 \cdot H_2O_2 \cdot 3\ H_2O$) and the monohydrate ($NaBO_2 \cdot H_2O_2$) are of particular importance. However, other $H_2O_2$-supplying borates can also be used, for example, perborax $Na_2B_4O_7 \cdot 4\ H_2O_2$. These compounds can be replaced partly or completely by other active oxygen-carriers, particularly by peroxyhydrates, such as peroxycarbonates ($Na_2CO_3 \cdot 1.5\ H_2O_2$), peroxypyrophosphates, citrate perhydrates, urea-$H_2O_2$ compounds or melamine-$H_2O_2$ compounds as well as by $H_2O_2$-supplying peracid salts, such as caroates ($KHSO_5$), perbenzoates or peroxyphthalates.

It is advisable to incorporate conventional, mostly water-insoluble stabilizers for the peroxy compounds together with the latter in amounts of 1% to 8%, preferably 2% to 7% by weight. Particularly suitable in this are the magnesium silicates, $MgO:SiO_2 = 4:1$ to 1:4, preferably 2:1 to 1:2, and particularly 1:1, which are mostly obtained by precipitation from aqueous solutions.

In order to achieve a satisfactory bleaching effect when washing at temperatures below 80° C., particularly in the range 60° C. to 40° C., the preparations should contain bleaching component activators, such as the N-acyl compounds.

The activators for the $H_2O_2$-supplying per compounds are certain N-acyl or O-acyl compounds forming organic per acids with this $H_2O_2$, particularly acetyl, propionyl or benzoyl compounds as well as carboxylic or pyrocarboxylic esters. Suitable compounds are, among others: N-diacylated and N,N' tetraacylated amines, like N,N,N'-N'-tetraacetylmethylene diamine or ethylene-diamine, N,N-diacetyl aniline, and N,N-diacetyl-p-toluidine, or 1,3-diacylated hydantoins, alkyl-N-sulfonyl-carbonamides, such as N-methyl-N-mesyl-acetamide, N-methyl-N-mesyl-benzamide, N-methyl-N-mesyl-p-nitrobenzamide, and N-methyl-N-mesyl-p-methoxy benzamide, N-acylated cyclic hydrazides, acylated triazoles or urazoles, such as monoacetyl maleic hydrazide, O,N,N-trisubstituted hydroxylamines, such as O-benzoyl-N,N-succinyl-hydroxylamine, O-acetyl-N,N-succinyl-hydroxylamine, O-p-methoxybenzoyl-N,N-succinyl-hydroxylamine, O-p-nitrobenzoyl-N,N-succinyl-hydroxylamine, and O,N,N-triacetyl-hydroxylamine, N,N'diacyl-sulfuryl-amides, such as N,N'-dimethyl-N,N'-diacetyl-sulfuryl amide, and N,N'-diethyl-N,N'-dipropionyl-sulfuryl amide, triacyl cyanurates, such as triacetyl-cyanurate or tribenzoyl-cyanurate, carboxylic acid anhydrides, such as benzoic acid anhydride, m-chlorobenzoic acid anhydride, phthalic acid anhydride, 4-chlorophthalic acid anhydride, sugar esters, like glucose pentaacetate, 1,3-diacyl-4,5-diacyloxy-imidazolidines, such as 1,3-diformyl-4,5-diacetoxy-imidazolidine, 1,3-diacetyl-4,5-diacetoxy-imidazolidine, 1,3-diacetyl-4,5-dipropionyloxy-imidazolidine, acylated glycolurils, like tetrapropionyl-glycoluril or diacetyl-dibenzoyl-glycoluril, diacylated 2,5-diketopiperazines, such as 1,4-diacetyl-2,5-diketopiperazine, 1,4-dipropionyl-2,5-diketopiperazine, 1,4-dipropionyl-3,6-dimethyl-2,5-diketopiperazine, acetylation- or benzoylation products of propylene diurea or 2,2-dimethyl propylene diurea (2,4,6,8-tetraaza-bicyclo-(3,3,1)-nonane-3,7-dione or its 9,9-dimethyl derivative), sodium salts of p-(ethoxycarbonyloxy)-benzoic acid and p-(propoxycarbonyloxy)-benzene sulfonic acid.

The detergents can contain optical brighteners for cotton particularly derivatives of diaminostilbene disulfonic acid or its alkali metal salts. Suitable are the salts of 4,4'-bis(2-anilino-4-morpholino-1,3,5-triazin-6-yl-amino)-stilbene-2,2'-disulfonic acid or similarly constituted compounds which contain instead of the morpholino group a diethanolamine group, methylamino group or a 2-methoxyethylamino group. The brighteners for polyamide fibers are those of the type of the 1,3-diaryl-2-pyrazolines, such as the compound 1-(p-sulfamoyl-phenyl)-3-(p-chlorophenyl)-2-pyrazoline, as well as similarly constituted compounds which contain instead of the sulfamoyl group, the methoxycarbonyl, the 2-methoxyethoxycarbonyl, the acetylamino or the vinyl-sulfonyl group. Suitable polyamide brighteners are also the substituted amino-cumarins, such as 4-methyl-7-dimethylaminocumarin or the 4-methyl-7-diethylaminocumarin. Also suitable as polyamide brighteners are the compounds 1-(2-benzimidazolyl)-2-(1-hydroxyethyl-2-benzimidazolyl)ethylene and 1-ethyl-3-phenyl-7-diethylamino-carbostyril. The brighteners for polyester and polyamide fibers are the compounds 2,5-di-(2-benzoxazolyl)-thiophene, 2-(2-benzoxazolyl)-naphtho-[2,3-b]-thiophene and 1,2-di-(5-methyl-2-benzoxazolyl)-ethylene. Furthermore brighteners of the type of the substituted 4,4'-distyryl-diphenyls can be present, such as the compound 4,4'-bis(4-chloro-3-sulfostyryl)diphenyl. Mixtures of the above-mentioned brighteners can also be used.

The water-soluble organic solvents which can be used are the lower alkanols, alkoxyalkanols, alkylene glycols or alkanones with 1 to 6 carbon atoms, such as methanol, ethanol, propanol, isopropyl alcohol, ethylene glycol, propylene glycol, diethylene glycol, methyl glycol, ethyl glycol, butyl glycol, or acetone and methylethyl ketone.

The following specific embodiments are illustrative of the invention without being limitative in any respect.

EXAMPLES

The following are a few typical representatives of the hydroxyalkylamines of Formulas I and II together with a description of their production. The substances are characterized by their turbidity point (according to DIN 53917). In difficultly soluble substances, that is, those which have a turbidity point in water of under 20° C., the turbidity point was measured in aqueous butyl diglycol according to DIN 52917.

PROCEDURE FOR THE PRODUCTION OF HYDROXYALKYLAMINES OF FORMULA I, W1–W12

The epoxy compound was added to a 1 to 10 molar excess of the amino compound at 150° C. to 200° C. It was necessary to stir vigorously since two phases formed initially. Subsequently the stirring was continued for 1 to 4 four hours at 180° C. to 200° C., and the excess amine (together with any existing paraffin and olefin) was distilled under reduced pressure so that the sump temperature did not rise above 200° C. The product thus obtained was generally not distilled. If the epoxide reaction products are to be alkoxylated, particularly ethoxylated, this can be done in known manner in the autoclave by reaction with the calculated amount of ethylene oxide or propylene oxide in the presence or absence of a catalyst, such as sodium methylate. A catalyst is not necessary, if only the hydrogen on primary or secondary amine groups is to be substituted. Otherwise 1.4 gm of sodium methylate were used per mol of the hydroxyalkylamine compound.

W1—The reaction product from a non-terminal $C_{11}$–$C_{14}$ epoxyalkane (chain length distribution as indicated above) and diethanolamine; turbidity point <0° C. (in aqueous butyl glycol).

W2—The reaction product from a non-terminal $C_{11}$–$C_{14}$ epoxyalkane and monoethanolamine; turbidity point 34° C. (in aqueous butyl glycol).

W3—The reaction product from a non-terminal $C_{11}$–$C_{14}$ epoxyalkane and hydroxyethyl-ethylenediamine; turbidity point 41° C. (in aqueous butyl glycol).

The turbidity points of the following products W4 to W12 were measured according to DIN 52917 all in aqueous butyl glycol.

W4—The reaction product from a non-terminal $C_{11}$–$C_{14}$ epoxyalkane and bis-hydroxyethoxyethylamine; turbidity point 44° C.

W5—The reaction product from a non-terminal $C_{11}$–$C_{14}$ epoxyalkane and diethanolamine, additionally ethoxylated with 1 mol of ethylene oxide; turbidity point 32° C.

W6—The reaction product from a non-terminal $C_{11}$–$C_{14}$ epoxyalkane and diethanolamine, additionally ethoxylated with 2 mols of ethylene oxide; turbidity point 45° C.

W7—The reaction product from a non-terminal $C_{11}$–$C_{14}$ epoxyalkane and diethanolamine, additionally reacted with 3 mols of ethylene oxide; turbidity point 59° C.

W8—The reaction product from a non-terminal $C_{11}$–$C_{14}$ epoxyalkane and ethylenediamine, additionally reacted with 4 mols of ethylene oxide; turbidity point 72.5° C.

W9—The reaction product from a non-terminal $C_{11}$–$C_{14}$ epoxyalkane and diethanolamine, additionally reacted with 1 mol of propylene oxide; turbidity point <3° C.

W10—The reaction product from a non-terminal $C_{11}$–$C_{14}$ epoxyalkane and diethanolamine, additionally reacted with 2 mols of propylene oxide; turbidity point 19° C.

W11—The reaction product from a non-terminal $C_{11}$–$C_{14}$ epoxyalkane and monohydroxyisopropylamine; turbidity point 14° C.

W12—The reaction product from a non-terminal $C_{11}$–$C_{14}$ epoxyalkane and di-hydroxyisopropylamine; turbidity point <0° C.

PROCEDURE FOR THE PRODUCTION OF THE ACYLATED HYDROXYALKYLAMINES OF FORMULA IIa 1 mol of the higher molecular weight epoxyalkane was added to an about 1 to 10 molar excess of the amino compound at 140° C. to 200° C. with vigorous stirring. The stirring was continued for 1 to 4 hours at 180° C. to 200° C. Thereafter, the excess amine (together with any existing paraffin and olefin) was so distilled off under reduced pressure that the sump temperature did not rise over 200° C. The intermediate product thus obtained was mixed with an equimolar amount of acetamide and heated to 150° C. under stirring, until the bulk of the $NH_3$ had escaped, and then was maintained for several hours at 180° C. to 200° C., while conducting nitrogen through the apparatus to remove the liberated ammonia. The product thus obtained was washed with water and dried under vacuum. As far as the acylation product was ethoxylated and/or propoxylated, this was done in the autoclave in known manner by reaction with the calculated amount of ethylene oxide in the absence or presence of a catalyst, such as sodium methylate.

Typical representatives of the acylated hydroxyalkylamines of Formula IIa are, for example, the following compounds W13 to W18 (turbidity points measured in aqueous butyl glycol according to DIN 53917).

W13—The reaction product from a non-terminal $C_{11}$–$C_{14}$ epoxyalkane and ethylenediamine, acylated with 1 mol of acetamide; turbidity point 35° C.

W14—The reaction product from a non-terminal $C_{11}$–$C_{14}$ epoxyalkane and trimethylenediamine, acylated with 1 mol of acetamide; turbidity point 49° C.

W15—The reaction product from a non-terminal $C_{11}$–$C_{14}$ epoxyalkane and 1 mol of ethylenediamine, acylated with 1 mol of acetamide; and additionally reacted with 1 mol of ethylene oxide (without catalyst).

W16—The reaction product from $\alpha$-$C_{12}$–$C_{14}$ epoxyalkane and ethylenediamine, acylated with 1 mol of acetamide and additionally reacted with 1 mol of ethylene oxide (without catalyst).

W17—The reaction product from a non-terminal $C_{11}$–$C_{14}$ epoxyalkane and hexamethylenediamine, acylated with 1 mol of acetamide.

W18—The reaction product from $\alpha$-$C_{12}$–$C_{14}$ epoxyalkane and diethylenetriamine, acylated with 1 mol of acetamide.

The following is the procedure for the production of acylated hydroxyalkylamines of Formula IIb used according to the invention, which were obtained by reacting a higher molecular weight epoxyalkane with a carboxylic acid amide and subsequent ethoxylation and/or propoxylation. The epoxyalkane was mixed with a 2- to 3-mol amount of the carboxylic acid amide and a catalyst, e.g., sodium methylate, was added in amounts of 1 to 3 mol percent based on the epoxyalkane. Then the product was heated for 2 to 7 hours to 140° C. to 190° C. and the excess amide was removed by extraction with water or by distillation. The colorless, crystalline intermediate product thus obtained was further reacted with ethylene oxide. The ethoxylation was effected in the autoclave in known manner by reaction with the calculated amount of ethylene oxide in the presence of a catalyst, e.g., sodium metylate.

Some of the typical substances of Formula IIb are listed in the Table below.

TABLE I

| Active Substance No. | Acylated Hydroxyalkylamine (Hydroxyalkylamide) | Turbidity Point DIN 5391 |
|---|---|---|
| W 19 | N-(2-hydroxy-$C_{15-18}$-alkyl)acetamide + 1 EO | 57° C.* |
| W 20 | N-(2-hydroxy-$C_{15-18}$-alkyl)-acetamide + 3 EO | 70° C.* |
| W 21 | N-(2-hydroxy-$C_{15-18}$-alkyl)-acetamide + 4 EO | |
| W 22 | N-(2-hydroxy-$C_{15-18}$-alkyl)-acetamide + 5 EO | |
| W 23 | N-(2-hydroxy-$C_{12/14}$-alkyl)-acetamide + 1 EO | |
| W 24 | N-(2-hydroxy-$C_{12/14}$-alkyl)-acetamide + 2 EO | |
| W 25 | N-(2-hydroxy-$C_{16/18}$-alkyl)-acetamide + 4 EO | |
| W 26 | N-(2-hydroxy-$C_{16/18}$-alkyl)-acetamide + 5 EO | |
| W 27 | N-(2-hydroxy-$C_{15-18}$-alkyl)-benzamide + 5.5 EO | |
| W 28 | N-i-vic.**-(hydroxy-$C_{15-18}$-alkyl)-acetamide + 4 EO | |
| W 29 | N-i-vic.**-(hydroxy-$C_{11-14}$-alkyl)-acetamide + 3 EO | |

*in butyl glycol
**i-vic. = non-terminal vicinal

The following examples describe the composition and the effect of some of the preparations according to the invention as well as the realization of the washing method according to the invention.

EXAMPLE 1

This example describes the composition of a foam-inhibited cold-temperature detergent, which is particularly suitable for washing machines:

| Percent by weight | |
|---|---|
| 6.0 | Sodium dodecylbenzene sulfonate |
| 1.0 | Adduct of 1 mol of tallow fatty alcohol and 14 mols of ethylene oxide |
| 1.0 | Adduct of 1 mol of oleyl-cetyl alcohol and 10 mols of ethylene oxide |
| 1.0 | Hydroxyalkylamine W 1 |

-continued

| Percent by weight | |
|---|---|
| 3.0 | Soap (sodium salt of $C_{18-22}$ fatty acids) |
| 60.0 | Sodium tripolyphosphate |
| 2.0 | Sodium carbonate |
| 2.5 | Waterglass ($Na_2O$ - 3.35 $SiO_2$) |
| 0.2 | Sodium ethylenediaminetetraacetate |
| 1.2 | Carboxymethylcellulose-sodium salt |
| | Balance - sodium sulfate and water. |

In order to determine the cold washing power, Launderometer ® tests were made under the following conditions:

Washing temperature: 20° C.
Water hardness: 16° dH
Detergent concentration: 6.0 gm/liter
Liquor ratio: 1:12 for unfinished cotton 1:30 for finished cotton and polyester-cotton
Washing time: 30 minutes.

The detergent was compared with a detergent which contained instead of the active substance W1, an additional 1% by weight of sodium sulfate or 1% by weight of sodium dodecylbenzene sulfonate. The following numerical values of the degree of brightening measured on the test fabrics show the marked improvement of the washing power with the use of the preparation according to the invention.

TABLE II

| Detergent | % Remission | | |
|---|---|---|---|
| | Cotton Unfinished | Cotton Finished | Cotton/ Polyester Finished |
| With Wl 1% | 48.7 | 64.2 | 61.5 |
| With 1% sodium sulfate | 45.3 | 58.2 | 51.2 |
| With 1% sodium dodecylbenzene sulfonate | 46.9 | 60.4 | 51.9 |

EXAMPLE 2

In the recipe of Example 1 the hydroxyalkylamine W1 used there was replaced by the acylated hydroxyalkylamines W13 and W14 in the Launderometer tests.

Washing temperature: 20° C.
Water hardness: 16° dH
Detergent concentration: 4.0 gm/liter
Liquor ratio: 1:30
Polyester-cotton fabrics as test materials
Washing time: 30 minutes.

This detergent was compared with a detergent where instead of the active substances 1% by weight of sodium sulfate or 1% by weight of nonylphenol polyethylene glycol monoether (degree of ethoxylation 7) were added. From the numerical values of Table III, clearly a marked improvement of the washing power with the use of the preparations according to the invention can be seen.

TABLE III

| Detergent | % Remission |
|---|---|
| | Cotton/Polyester Finished |
| With 1% W 13 | 61.8 |
| With 1% W 14 | 60.4 |
| With 1% sodium sulfate | 50.0 |
| With 1% nonylphenol poly-(hepta)-ethylene glycol monoether | 55.4 |

EXAMPLE 3

A Launderometer test was carried out in analogy to Example 1 with unfinished cotton and polyester/cotton fabrics. The acylated hydroxyalkylamines W19 and W20 (Formula IIb) were used as active substances. The values of Table IV show clearly the improved washing power of the detergents according to the invention.

TABLE IV

| Detergent | % Remission | |
|---|---|---|
| | Cotton Unfinished | Cotton/ Polyester Finished |
| With 1% W 19 | 57.5 | 61.5 |
| With 1% W 20 | 58.1 | 64.3 |
| With 1% sodium dodecylbenzene sulfonate | 54.1 | 58.8 |
| With 1% sodium sulfate | 53.4 | 58.6 |

The following are further examples of washing and cleaning agents according to the invention. The salt-type components of the washing and cleaning agents mentioned in the examples, such as salt-type surface-active agents, other organic salts, as well as inorganic salts, are present as sodium salts unless specifically stated otherwise. The designations and abbreviations in the examples have the following meaning:

ABS—The salts of an alkylbenzene sulfonic acid with 10 to 15, substantially 11 to 13, carbon atoms in the alkyl chain, obtained by condensation of the straight-chained olefins with benzene and sulfonation of the alkylbenzene thus obtained.

Olefin Sulfonate—A mixture of hydroxyalkane sulfonates alkene sulfonates and alkane disulfonates, obtained by sulfonation of α-olefins with 12 to 18 carbon atoms with $SO_3$ and hydrolization of the sulfonation product with sodium hydroxide solution.

FS-ester sulfonate—A sulfonate obtained from hydrogenated palm kernel fatty acid methyl ester by sulfonation with $SO_3$.

Alkane sulfonate—A sulfonate obtained by the sulfoxidation of $C_{12-18}$ paraffins.

Soap—A soap produced from a hardened mixture of equal parts by weight of tallow fatty acids and rape oil fatty acids (iodine number 1).

TA+xEO, KA+xEO, OCA+xEO, OXO+xEO—The addition products of x mols of ethylene oxide (EO) onto 1 mol of technical tallow alcohol (TA) (iodine number 0.5) or coconut alcohol (KA) or oleyl/cetyl alcohol (OCA) (iodine number 50) or a $C_{14/15}$ oxoalcohol with about 25% α-methyl branching (OXO).

Bleach activator—The compound tetraacetylglycoluril.

Waterglass—A sodium silicate of the composition: $Na_2O.3.35SiO_2$.

Perborate—A technical product of the approximate composition: $NaBO_2.H_2O_2.3H_2O$.

EDTA—The salt of ethylenediaminetetraacetic acid.

NTA—The salt of nitrilo triacetic acid.

CMC—The salt of carboxymethylcellulose.

PHAS—Poly-α-hydroxyacrylate (molecular weight: 35,000 to 40,000).

In the following Table V, Examples 4, 5, 10, 11 and 12 relate to powdered detergents with a bleaching action. Examples 6 and 7 relate to powdered prewashing and main washing agents without bleaching action.

Examples 8 and 9 relate to a powdered fine detergent and a liquid detergent, respectively.

The ingredients of the detergents according to the invention particularly the builder substances, are so selected that the preparations react neutral to alkaline, so that the pH value of a 1% solution of the preparation is in the range of 7 to 12. Fine detergents have a neutral to weakly alkaline reaction (pH value=7 to 9.5), while soaking-, prewashing- and high temperature washing agents react more alkaline (pH value=9.5 to 12, preferably 10 to 11.5).

TABLE V

| Components | Detergent Components in % for Examples | | | | | | | | |
|---|---|---|---|---|---|---|---|---|---|
| | 4 | 5 | 6 | 7 | 8 | 9 | 10 | 11 | 12 |
| ABS | 6.0 | — | — | — | 6.5 | — | 6.0 | 6.0 | — |
| TA + 14 EO | 1.0 | — | 1.0 | 1.5 | — | 4.0 | 1.0 | 2.5 | 4.0 |
| TA + 5 EO | 1.0 | 1.5 | 1.0 | — | — | — | 1.0 | 1.5 | — |
| Fs-ester sulfonate | — | — | 3.0 | 6.0 | — | — | — | — | — |
| Alkane sulfonate | — | — | — | — | — | 8.0 | — | — | — |
| Olefin sulfonate | — | 6.0 | 3.0 | — | — | — | — | — | — |
| Tallow alcohol + 3 EO sulfate | — | — | — | — | 4.0 | — | — | — | — |
| Soap | 3.5 | 3.5 | 2.5 | 3.0 | 0.5 | — | 3.0 | 3.0 | 3.0 |
| Potassium toluene sulfonate | — | — | — | — | — | 4.0 | — | — | — |
| W1 | 1.0 | — | — | — | 1.5 | — | — | 1.5 | 1.0 |
| W3 | — | — | 1.0 | — | — | 1.8 | — | — | — |
| W2 | — | 0.4 | — | — | — | — | 1.5 | — | — |
| W7 | — | — | — | 1.5 | — | — | — | — | — |
| $Na_5P_3O_{10}$ | 40.0 | 30.0 | 60.0 | 55.0 | 40.0 | — | — | 40.0 | 35.0 |
| NTA | — | 5.0 | — | 5.0 | — | — | — | — | — |
| $K_4P_2O_7$ | — | — | — | — | — | 10.0 | — | — | — |
| EDTA | 0.2 | 0.2 | — | — | — | — | 0.2 | 0.2 | 0.2 |
| Perborate | 15.0 | 15.0 | — | — | — | — | 20.0 | 25.0 | 15.0 |
| Bleach activator | 15.0 | 15.0 | — | — | — | — | — | — | 15.0 |
| Waterglass | 3.0 | 3.0 | 4.0 | 5.0 | 3.5 | — | 15.0 | 3.0 | 5.0 |
| Sodium carbonate | — | — | 3.0 | 3.0 | — | — | 6.0 | — | — |
| Mg silicate | 2.0 | 2.0 | — | — | — | — | 2.0 | 2.0 | 2.0 |
| CMC | 1.5 | 1.8 | 1.5 | 1.4 | — | — | 1.2 | 1.5 | 1.5 |
| Isopropylalcohol | — | — | — | — | — | 5.0 | — | — | — |

Balance:
Na sulfate, enzymes, optical brighteners, perfume, except Example 9. In Example 9, the balance is water only.

If, in the detergents of Table V, the hydroxyalkylamines of Formula I contained therein are replaced by other active substances of Formula I, such as by the substances W4 and W5, or by the acylated hydroxyalkylamines of Formula IIa, such as the substances W13 or W14, or by the acylated hydroxyalkylamines of Formula IIb, such as the substances W19, W20 or W21, compositions are obtained with comparable properties. Comparable washing results are also obtained if, in the recipe of Examples 4, 8 and 11, for example, half of the 40% of sodium tripolyphosphate contained therein is replaced by a crystalline aluminosilicate of the composition:

$$0{:}96Na_2O.1Al_2O_3.1.96SiO_2.4H_2O$$

with an average particle diameter of 5.4$\mu$ and a calcium binding power of 172 mg CaO/gm on the anhydrous basis.

EXAMPLES 13 TO 24

These examples describe recipes for full-range detergents with a tenside component of non-ionic surface-active compounds and with a reduced phosphate content, compared to the conventional full-range detergents. The recipes are given in Tables VI and VII.

TABLE VI

| Components | Detergent Component in % by Weight For Examples | | | | | |
|---|---|---|---|---|---|---|
| | 13 | 14 | 15 | 16 | 17 | 18 |
| TA + 5 EO | 6.2 | — | — | — | 5.6 | 4.1 |
| KA + 3 EO | — | — | 3.7 | — | — | — |
| OCA + 5 EO | — | 4.4 | — | 5.5 | — | — |
| OXO + 4 EO | — | — | — | — | — | — |
| TA + 14 EO | 4.1 | — | — | — | 2.4 | 3.8 |
| KA + 12 EO | — | — | — | — | — | — |
| OCA + 10 EO | — | 3.6 | 3.4 | — | — | — |
| OXO + 9 E | — | — | — | 2.5 | — | — |
| Soap | 1.6 | 1.3 | 1.6 | 2.0 | 1.5 | 1.5 |
| W1 | — | 2.2 | — | — | 2.0 | — |
| W2 | — | — | 2.5 | — | — | 1.9 |
| W5 | 1.3 | — | — | 1.8 | — | — |
| Sodium tripolyphosphate | 26.0 | 30.0 | 30.0 | 30.0 | 30.0 | 30.0 |
| Waterglass | 5.0 | 3.0 | 3.0 | 3.0 | 3.0 | 3.0 |
| Mg silicate | 2.5 | 2.0 | 2.0 | 2.0 | 2.0 | 2.0 |
| Perborate | 28.0 | 25.0 | 25.0 | 25.0 | 25.0 | 25.0 |
| EDTA | 0.3 | 0.2 | 0.2 | 0.2 | 0.2 | 0.2 |
| CMC | 1.0 | 1.4 | 1.4 | 1.4 | 1.4 | 1.4 |
| PHAS | — | — | — | — | — | — |

Balance: enzymes, optical brighteners, sodium sulfate, water

TABLE VII

| Components | Detergent Component in % by Weight For Examples | | | | | |
|---|---|---|---|---|---|---|
| | 19 | 20 | 21 | 22 | 23 | 24 |
| TA + 5 EO | 2.9 | — | 4.6 | — | 7.1 | 5.3 |
| KA + 3 EO | — | — | — | — | — | — |
| OCA + 5 EO | — | — | — | — | — | — |
| OXO + 4 EO | — | 5.3 | — | 5.3 | — | — |
| TA + 14 EO | 2.9 | — | — | — | 4.1 | 3.8 |
| KA + 12 EO | — | — | — | 2.2 | — | — |
| OCA + 10 EO | — | — | 3.4 | — | — | — |
| OXO + 9 EO | — | 2.9 | — | — | — | — |
| Soap | 1.5 | 1.2 | 1.7 | 1.8 | 1.8 | 1.4 |
| W1 | — | 1.7 | 1.9 | — | — | — |
| W2 | — | — | — | 2.1 | — | — |
| W5 | 2.0 | — | — | — | 1.0 | 1.5 |
| Sodium tripolyphosphate | 30.0 | 24.0 | 30.0 | 30.0 | 30.0 | 30.0 |

TABLE VII-continued

| Components | Detergent Component in % by Weight For Examples | | | | | |
|---|---|---|---|---|---|---|
| | 19 | 20 | 21 | 22 | 23 | 24 |
| Waterglass | 5.0 | 3.5 | 3.0 | 3.0 | 3.0 | 3.0 |
| Mg silicate | 1.0 | 1.8 | 2.0 | 2.0 | 2.0 | 2.0 |
| Perborate | 25.0 | 23.0 | 25.0 | 25.0 | 25.0 | 25.0 |
| EDTA | 0.2 | 0.15 | 0.2 | 0.2 | 0.2 | 0.2 |
| CMC | 1.1 | 1.5 | 1.4 | 1.4 | 1.4 | 1.4 |
| PHAS | — | 5.0 | — | — | — | — |

Balance: enzymes, optical brighteners, sodium sulfate, water.

EXAMPLE 25

This example shows on the basis of comparison tests with commercial detergents, the excellent primary washing power of the compositions with a reduced phosphate content and nonionic tenside components according to the invention. Of the following recipe in Table VIII, Formulation 25*a* refers to a commercial high phosphate preparation and Formulation 25*b* to a commercial preparation with a reduced phosphate content. The Formulations 25*c* and 25*d* according to the invention contain 8% by weight of a combination of two nonionic tensides together with 2% by weight of a hydroxyalkylamine of Formula I.

The washing tests were made in the Launderometer with a liquor ratio of 1:12.5 at temperatures of 60° C. and 90° C., respectively, for 30 minutes, of which 20 minutes was done under heating, with dosages of 3 gm/liter and 4.5 gm/liter, employing water of the hardness 16° dH. The test fabrics employed were partially soiled fabrics of unfinished Cotton or Polyester/Cotton. For the evaluation of the washing power, the whiteness of the washed samples was determined in a color filter measuring-instrument RFC by Zeiss, Germany, using an R-46 filter. From the remission values in Table IX, it can be seen that the primary washing power of the detergents according to the invention is equal to or even better than that of the commercial preparations.

TABLE VIII

| Components | Amount in % by Weight for Examples | | | |
|---|---|---|---|---|
| | 25a | 25b | 25c | 25d |
| ABS | 6.0 | — | — | — |
| TA-14 EO | 2.7 | 3.0 | 2.4 | 2.4 |
| TA-5 EO | 1.3 | 7.0 | 5.6 | 5.6 |
| W2 | — | — | 2.0 | — |
| W5 | — | — | — | 2.0 |
| Soap | 3.0 | 1.5 | 1.5 | 1.5 |
| Sodium triphosphate | 40.0 | 30.0 | 30.0 | 30.0 |
| EDTA | 0.2 | 0.2 | 0.2 | 0.2 |
| Waterglass | 3.4 | 4.5 | 4.5 | 4.5 |
| Soda | — | 2.5 | 2.5 | 2.5 |
| Perborte | 26.0 | 30.0 | 30.0 | 30.0 |
| Mg silicate | 2.0 | 2.5 | 2.5 | 2.5 |
| CMC | 1.4 | 1.4 | 1.4 | 1.4 |

Balance: Sodium sulfate and water

TABLE IX

| Examples | % Remission | |
|---|---|---|
| | Unfinished Cotton Washing Temp. 90° C. Dosage 3 gm/liter | Polyester/Cotton Washing Temp. 60° C. Dosage 4.5 gm/l |
| 25a | 42.8 | 50.8 |
| 25b | 47.7 | 49.6 |
| 25c | 50.3 | — |
| 25d | — | 51.0 |
| | Significance $LSD_{95}$ | Significance $LSD_{95}$ |

TABLE IX-continued

| Examples | % Remission | |
|---|---|---|
| | Unfinished Cotton Washing Temp. 90° C. Dosage 3 gm/liter | Polyester/Cotton Washing Temp. 60° C. Dosage 4.5 gm/l |
| | = 1.4 | = 0.4 |

The preceding specific embodiments are illustrative of the practice of the invention. It is to be understood, however, that other expedients known to those skilled in the art or disclosed herein may be employed without departing from the spirit of the invention or the scope of the appended claims.

We claim:

1. A surface-active compound combination for use in textile washing agent compositions consisting essentially of (1) at least one tenside selected from the group consisting of anionic surface-active compounds of the sulfonate and sulfate type and nonionic surface-active compounds of the ethoxylated higher alkanols, higher alkenols, higher alkanediols and higher alkylphenols, and (2) at least one hydroxyalkyl compound selected from the group consisting of (A) hydroxyalkyl amines of the formula

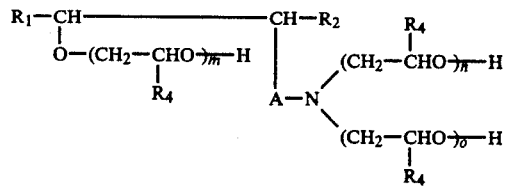

wherein $R_1$ is alkyl having 1 to 16 carbon atoms, $R_2$ is a member selected from the group consisting of hydrogen and alkyl having 1 to 16 carbon atoms, and the sum of the carbon atoms in $R_1+R_2$ is from 6 to 20 with the proviso that when $R_2$ is H, $R_1$ is alkyl having 6 to 16 carbon atoms, $R_4$ is a member selected from the group consisting of hydrogen and methyl, m, n and o represent integers from 0 to 3 and A is a bridging bond selected from the group consisting of:

(a) a single bond between the carbon and the nitrogen, (b)

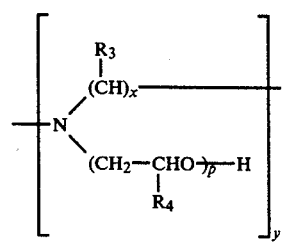

(c)

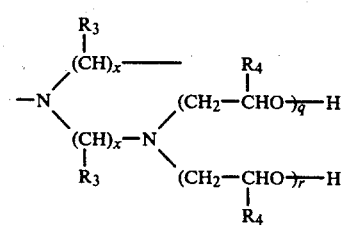

-continued and

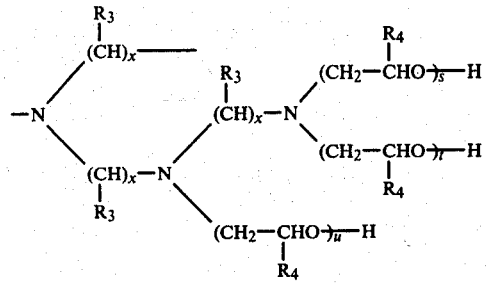

(d)

wherein $R_3$ is a member selected from the group consisting of hydrogen and methyl, x is an integer from 2 to 6, y is an integer from 1 to 3, p, q, r, s, t, and u represent integers from 0 to 3, with the provisos (a) that when A is a single bond between the carbon and the nitrogen, $R_2$ is alkyl having 1 to 16 carbon atoms and m is 0, and (b) that when A is other than a single bond between the carbon and the nitrogen, the sum of m to u is from 1 to 5.5 and (B) acylated hydroxyalkyl amines of the formula

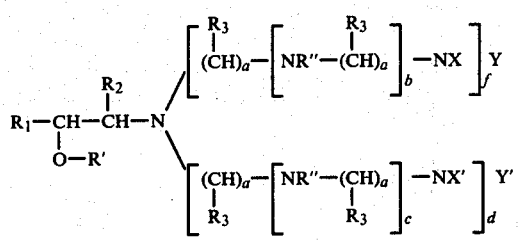

wherein $R_1$, $R_2$ and $R_3$ have the above-assigned values, X and X' are each members selected from the group consisting of hydrogen and $$-(CH_2-\underset{R_4}{CH}-O)_e-H$$

wherein $R_4$ has the above-assigned value and e is an integer from 1 to 3, Y, Y', R' and R'' are each members selected from the group consisting of hydrogen, alkanoyl having from 1 to 12 carbon atoms in the alkane, hydrocarbon aroyl having from 7 to 12 carbon atoms and $$-(CH_2-\underset{R_4}{CH}-O)_e-H$$

where $R_4$ and e have the above-assigned values, a is an integer from 2 to 6, b is an integer from 0 to 2, c is an integer from 0 to 1, d and f are integers from 0 to 1, with the provisos (d) that at least one of Y, Y', R' and R'' is said alkanoyl or said aroyl, (e) that the sum of b, c, d and f does not exceed 3, (f) that when d and f are 0, Y is said alkanoyl or said aroyl, Y' is $$-(CH_2-\underset{R_4}{CH}-O)_e-H$$

and R' is hydrogen or $$-(CH_2-\underset{R_4}{CH}-O)_e-H$$

wherein the amount of component (1) to component (2) is in the weight ratio of 100:1 to 1:1.

2. The surface-active compound composition of claim 1 wherein the sum of the carbon atoms in $R_1$ and $R_2$ is from 8 to 18.

3. The surface-active compound composition of claim 1 wherein, when $R_4$ is methyl uniformly, the sum of m to u is from 1 to 2.

4. The surface-active compound composition of claim 1 wherein said alkanoyl has from 1 to 6 carbon atoms in the alkane.

5. The surface-active compound composition of claim 1 wherein said alkanoyl has from 1 to 4 carbon atoms in the alkane.

6. The surface-active compound composition of claim 1 wherein the weight ratio of component (1) to component (2) is from 20:1 to 2:1.

7. The surface-active compound composition of claim 1 wherein the weight ratio of component (1) to component (2) is from 10:1 to 3:1.

8. The surface-active compound composition of claim 1 wherein said component (2) has a turbidity point of below 50° C. as determined in water according to DIN 53917.

9. A washing agent composition for textiles consisting of from 5% to 50% by weight of said surface-active compound composition of claim 1 and the remainder at least one detergent component of the type: inorganic builder salts, organic builder salts, bleaching components, foam-inhibitors, optical brighteners, soil suspension agents, enzymes, antimicrobial agents, dyes, perfumes, water-soluble inert inorganic salts, water, organic solvents, and hydrotopic agents.

10. The washing agent composition of claim 9 wherein said bleaching components are present in an amount of from 10% to 40% by weight and consist of peroxy compounds, peroxy compound stabilizers and, optionally, peroxy compound activators.

11. A washing agent composition for textiles consisting essentially of (a) from 5.1% to 55% by weight of said surface-active compound composition of claim 1 wherein component (1) is present in an amount of 5% to 50% by weight of the washing agent composition and component (2) is present in an amount of from 0.1% to 5% by weight of the washing agent composition and the weight ratio of component (1) to component (2) is from 20:1 to 2:1, (b) from 0 to 8% by weight of a foam inhibitor selected from the group consisting of alkali metal soaps of higher fatty acids, at least 50% of which have from 18 to 22 carbon atoms, and the non-surface-active foam inhibitors, (c) from 50% to 94.9% by weight of powdery or liquid carriers for surface-active components selected from the group consisting of powdery inorganic builder salts, powdery organic builder salts, water-soluble lower alkanols, water-soluble lower alkanediols, water-soluble alkoxyalkanols, water-soluble alkoxyalkoxyalkanols, water, with the proviso that up to 40% by weight of the total composition of said powdery inorganic and organic builder salts can be replaced by bleach components, (d) from 0 to 10% by weight of at least one further additive of the type: optical brighteners, enzymes, soil suspension agents, textile fabric softeners, antimicrobial agents, dyes and perfumes.

12. The composition of claim 11 wherein, in component (a) component (1) is present in an amount of from 5% to 25% by weight and component (2) is present in an amount of from 0.3% to 3% by weight, component (b) is present in an amount of from 0.2% to 5% by weight, component (c) is present in an amount of from 55% to 90% by weight and component (d) is present in an amount of from 0.5% to 10% by weight.

13. The composition of claim 11 wherein said component (a) (1) is a mixture of said anionic surface-active compound of the sulfonate type and said nonionic surface-active compound of the type of ethoxylated alkanols having 10 to 20 atoms.

14. The composition of claim 11 wherein said component (a) (1) is a mixture of alkanols having 10 to 20 carbon atoms ethoxylated with from 8 to 20 mols of ethylene oxide and alkanols having 10 to 20 carbon atoms ethoxylated with from 2 to 7 mols of ethylene oxide in a weight ratio of 5:1 to 1:3.

15. The composition of claim 11 wherein said component (b) is selected from the group consisting of from 0.2% to 0.8% by weight of said non-surface-active foam inhibitors, from 0.5% to 5% by weight of said alkali metal soaps, and from 0.2% to 5% by weight of a mixture of said non-surface-active foam inhibitors and said alkali metal soaps.

16. The composition of claim 11 wherein said component (a) (2) is a hydroxyalkyl amine of the formula

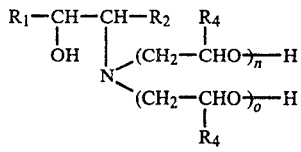

wherein $R_1$ is an alkyl having 1 to 16 carbon atoms, $R_2$ is a member selected from the group consisting of hydrogen and alkyl having 1 to 16 carbon atoms and the sum of the carbon atoms in $R_1$ and $R_2$ is from 6 to 20 with the proviso that when $R_2$ is hydrogen, the alkyl of $R_1$ has 6 to 16 carbon atoms, $R_4$ is a member selected from the group consisting of hydrogen and methyl, A stands for one of the groups (b), (c) or (d) of claim 1, and n and o, as well as p to u in A represent the integers 0 and 1. where the sum of n to u is from 1 to 5.5.

17. The composition of claim 16 wherein the sum of the carbon atoms in $R_1$ and $R_2$ is from 8 to 18.

18. The composition of claim 16 wherein $R_4$ is hydrogen.

19. The composition of claim 11 wherein component (a)(2) is a hydroxylamine of the formula

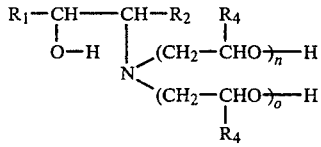

wherein $R_1$ and $R_2$ are alkyl having from 1 to 16 carbon atoms and the sum of the carbon atoms in $R_1+R_2$ is in the range of 6 to 20, $R_4$ is selected from the group consisting of hydrogen and methyl, n and o are integers from 0 to 3, and the sum of n+o corresponds at least to the value 1.

20. The composition of claim 19 wherein the sum of n+o is between 2 and 5.

21. The composition of claim 11 wherein component (a)(2) is said acylated hydroxyalkylamine of component (B).

22. The composition of claim 21 wherein, in said acylated hydroxyalkylamine of component (B), X and X' are hydrogen and R', R'', R and Y' are selected from the group consisting of alkanoyl having from 1 to 6 carbon atoms in the alkyl and hydrogen, where at least one of R', R'', Y and Y' is alkanoyl.

23. The composition of claim 11 wherein in component (a)(2) is an acylated hydroxyalkylamine of the formula

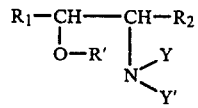

wherein $R_1$ is alkyl having 1 to 16 carbon atoms, $R_2$ is a member selected from the group consisting of hydrogen and alkyl having 1 to 16 carbon atoms, the sum of the carbon atoms in $R_1+R_2$ is from 6 to 20 with the proviso that when $R_2$ is H, $R_1$ is alkyl having 6 to 16 carbon atoms, R' is a member selected from the group consisting of hydrogen and

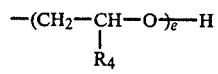

$R_4$ and e have the above-assigned values, Y is a member selected from the group consisting of alkanoyl having from 1 to 12 carbon atoms in the alkane and hydrocarbon aroyl having from 7 to 12 carbon atoms, and Y' represents

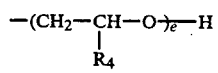

wherein $R_4$ and e have the above-assigned values.

24. A high temperature detergent for textiles with a reduced phosphate content consisting essentially of (a) from 5.5% to 18.5% by weight of said surface-active compound composition of claim 1 wherein component (1) is present in an amount of from 5% to 15% by weight of the detergent composition and consists of a nonionic surface-active compound mixture of (i) an alcohol having 10 to 20 carbon atoms selected from the group consisting of alkanols and alkenols adducted with from 2 to 7 mols of ethylene oxide and (ii) an alcohol having 10 to 20 carbon atoms selected from the group consisting of alkanols and alkenols adducted with from 8 to 20 mols of ethylene oxide, in a weight ratio of (i) to (ii) of 3:1 to 1:1, and component (2) is present in an amount of 0.5% to 3.5% by weight of the detergent composition, and the weight ratio of component (1) to component (2) is from 20:1 to 2:1, (b) from 0.5% to 3.5% of alkali metal soaps of higher fatty acids, at least 50% of which have from 18 to 22 carbon atoms, as a foam inhibitor, (c) from 15% to 35% by weight of a water-soluble condensed alkali metal phosphate, (d) from 0 to 30% by weight of phosphate-free builder salts selected from the group consisting of inorganic builder salts and organic builder salts, (e) from 10% to 40% by weight of a bleaching component consisting of a peroxy compound, peroxy compound stabilizers, and, optionally, peroxy compound activators, and (f) from 0 to 30% by weight of at least one further additive of the type: optical brighteners, enzymes, soil suspension agents, textile fabric softeners, antimicrobial agents, dyes and perfumes.

25. The high temperature detergent of claim 24 wherein, in component (a), component (1) is present in an amount of 5.5% to 12% by weight and the ratio of (i) to (ii) is from 2.4:1 to 1.1:1, component (2) is present in amount of from 1% to 2.5% by weight and the ratio of (1) to (2) is from 10:1 to 3:1, component (b) is present in an amount of from 1% to 2% by weight, component (c) is present in an amount of 20% to 30% by weight and is sodium tripolyphosphate, component (d) is present in an amount of 0.1% to 21% by weight, component (e) is present in an amount of 18% to 30% by weight and said peroxy compound is sodium perborate tetrahydrate and component (f) is present in an amount of 0.5% to 10% by weight.

26. The high temperature detergent of claim 24 wherein said component (a)(2) is a hydroxylamine of the formula

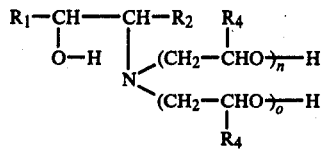

wherein $R_1$ and $R_2$ are alkyl having from 1 to 16 carbon atoms and the sum of the carbon atoms in $R_1+R_2$ is in the range of 6 to 20, $R_4$ is selected from the group consisting of hydrogen and methyl, n and o are integers from 0 to 3, and the sum of n+o corresponds at least to the value 1.

27. The high temperature detergent of claim 25 wherein said component (d) consists of from 0.1% to 1% by weight of organic sequestering agents for calcium and heavy metal ions and from 2% to 20% by weight of wash alkalis.

28. The high temperature detergent of claim 27 wherein said wash alkalis are selected from the group consisting of sodium silicates and sodium sulfate.

29. A method of washing soiled textiles which comprises agitating the same for 10 to 60 minutes in an aqueous wash liquor at a temperature of from 10° C. to 30° C., said aqueous wash liquor containing from 0.5 gm per liter to 6.0 gm per liter of the surface-active compound composition of claim 1 and from 0.5 gm per liter to 6.0 gm per liter of builder salts.

* * * * *